US008444438B2

(12) United States Patent
Gao et al.

(10) Patent No.: US 8,444,438 B2
(45) Date of Patent: May 21, 2013

(54) HIGH-SPEED CARD CONNECTOR HAVING WIDE POWER CONTACT

(75) Inventors: Zheng Gao, San Jose, CA (US); George Marc Simmel, Cupertino, CA (US); Euan Abraham, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/183,398

(22) Filed: Jul. 14, 2011

(65) Prior Publication Data

US 2012/0083164 A1 Apr. 5, 2012

Related U.S. Application Data

(63) Continuation-in-part of application No. 12/894,437, filed on Sep. 30, 2010, now Pat. No. 8,317,542.

(51) Int. Cl.
*H01R 13/648* (2006.01)

(52) U.S. Cl.
USPC ..... 439/607.35

(58) Field of Classification Search
USPC .... 439/79, 108, 495, 607.01, 607.31–607.33, 439/607.35, 607.23, 607.4, 636–637
See application file for complete search history.

(56) References Cited

U.S. PATENT DOCUMENTS

| | | | | |
|---|---|---|---|---|
| 4,349,237 | A * | 9/1982 | Cobaugh et al. | 439/377 |
| 5,004,426 | A * | 4/1991 | Barnett | 439/82 |
| 6,575,791 | B1 * | 6/2003 | Korsunsky | 439/637 |
| 7,021,942 | B2 * | 4/2006 | Grant et al. | 439/66 |
| 7,614,920 | B1 * | 11/2009 | Yi | 439/682 |
| 7,914,321 | B2 * | 3/2011 | Huang | 439/495 |
| 2006/0040556 | A1 * | 2/2006 | Neer et al. | 439/607 |
| 2006/0189222 | A1 | 8/2006 | Bogiel et al. | |
| 2006/0223377 | A1 | 10/2006 | Chang et al. | |
| 2008/0064237 | A1 | 3/2008 | Zhang | |
| 2009/0156049 | A1 | 6/2009 | Yen et al. | |
| 2010/0259891 | A1 | 10/2010 | Tachikawa | |
| 2011/0021054 | A1 | 1/2011 | Huang | |

OTHER PUBLICATIONS

International Search Report mailed on Feb. 29, 2012, for PCT Patent Application No. PCT/US2011/053514, 8 pages.
Written Opinion of the International Searching Authority mailed on Feb. 29, 2012, for PCT Patent Application No. PCT/US2011/053514, 9 pages.
Non-Final Office Action mailed on Mar. 16, 2012 for U.S. Appl. No. 12/894,437, filed Sep. 30, 2010, 6 pages.
Notice of Allowance mailed on Jul. 23, 2012 for U.S. Appl. No. 12/894,437, filed Sep. 30, 2010, 5 pages.
Non-Final Office Action mailed on Apr. 24, 2012 for U.S. Appl. No. 13/339,325, filed Dec. 28, 2011, 17 pages.

* cited by examiner

*Primary Examiner* — Khiem M Nguyen
(74) *Attorney, Agent, or Firm* — Kilpatrick Townsend & Stockton LLP

(57) ABSTRACT

Connectors to connect optional or daughter cards or boards to main or motherboards. One example provides a connector that is capable of supporting high-speed data rates by employing contacts that provide short signal paths and a ground plane to improve signal quality. The space consumed in electronic devices may be reduced by providing a connector having a low profile, while another example may provide a connector having mechanical stability. Another example provides a connector having an increased manufacturability. Other examples include wider contacts for increased current capabilities.

25 Claims, 14 Drawing Sheets

HIGH-SPEED CARD CONNECTOR HAVING WIDE POWER CONTACT

CROSS-REFERENCES TO RELATED APPLICATIONS

This application is a continuation-in-part of U.S. application Ser. No. 12/894,437, filed Sep. 30, 2010, which is incorporated by reference.

BACKGROUND

The number and types of electronic devices on the market have grown tremendously the past few years. Tablet, netbook, laptop, and all-in-one computers, media players, handheld media players, cell phones, and other devices have proliferated. These devices have proliferated not only in the types that are available, but also as to the functionality they include.

Moreover, options for some particular devices have also proliferated. For example, for a particular device, the size of an internal memory may be an option. Other functionalities, such as video or graphics cards, network connections, and others, may also be made available as options or as possible upgrades. This allows a manufacturer to offer products at several price points, and allows customers to buy only the amount of functionality that is required to suit their needs and to possibly upgrade at a later time.

In these devices, various options may be added by including an optional card or board inside a housing of the electronic device. Also, certain cards or boards may be manufactured separately, for example, by a different manufacturer. In these and other situations, it may be desirable to include the card in the electronic device as a daughter card or board. These optional or daughter cards or boards may be attached to a main or motherboard. Specifically, these optional or daughter cards or boards may be attached to a board inside the electronic device housing a connector.

Unfortunately, these connectors consume space inside the electronic device housing. This consumed space may increase the size of the electronic device or reduce the functionality that could otherwise be included in the electronic device. Also, data rates among devices in these electronic devices have increased tremendously. Using a connector may degrade signal quality and reduce the data rates to a lower frequency that may otherwise be achievable.

Thus, what is needed are connectors that can be used to connect optional or daughter cards or boards to main or motherboards in electronic devices. It may also be desirable for these connectors to have a reduced size and to be able to support high data rates.

SUMMARY

Accordingly, embodiments of the present invention may provide connectors to connect optional or daughter cards or boards to main or motherboards. An illustrative embodiment of the present invention may provide a connector that is capable of supporting high-speed data rates. This connector may employ contacts that provide short signal paths. The contacts may have a first prong and a second prong. The first prong may attach to a surface of a main or motherboard. The second prong may form an electrical connection with a contact on a daughter or optional card or board. This embodiment may also provide a ground plane to improve signal quality. In a specific embodiment of the present invention, the ground plane may be on a top side of a connector and contacts for power and data may be on a second side of the connector. In this or other embodiments of the present invention, the ground plane may be split into two or more portions. In this way, in the event of warping of the connector shield, the ground plane may still contact the daughter or optional board in multiple locations. In a specific embodiment of the present invention, the ground plane may be split into three portions.

Another illustrative embodiment of the present invention may reduce the space consumed in electronic devices by providing a connector having a low profile. This low profile may be achieved by having the short signal paths, where each signal path may include contacts having a first prong that attaches to a main or motherboard and a second prong that forms an electrical connection to a contact on the daughter or optional board.

Another illustrative embodiment of the present invention may also provide a connector having mechanical stability. In a specific embodiment of the present invention, this may be achieved by providing a contact having a third prong. This third prong may be located parallel to a bottom surface of the connector as to reduce or eliminate any increase in the profile or height of the connector that may otherwise result due to its inclusion.

Another illustrative embodiment of the present invention may provide a connector having an increased manufacturability. In a specific embodiment of the present invention, the first contact prongs may be surface mount leads. These surface mount leads may be located in front of the connector. When these surface mount leads are connected to a board by soldering or other method, the connection to the board may be easily inspected. In another specific embodiment of the present invention, the connector may include one or more windows. These windows may allow inspection of an inserted daughter or optional card. Specifically, these windows may be used to ensure that a daughter or optional card is fully inserted into the connector.

Another illustrative embodiment of the present invention may provide a connector having one or more contacts having increased current carrying capabilities. These contacts may be formed wider as compared to other contacts, or they may be two or more contacts placed together in a connector. The wider contacts may be used to convey power, ground, or other type of electronic signals or information.

Another illustrative embodiment of the present invention may include one or more tabs connected to a shield, where the tabs may be soldered or otherwise fixed to grounds on a printed circuit board. These embodiments may also include one or more solder ends, where the solder ends are also soldered or otherwise fixed to grounds on the printed circuit board.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Electronic devices often include a first printed circuit board onto which one or more circuits are attached. Signal traces and ground and power planes on the first printed circuit board connect these circuits together, such that a desired functionality is achieved. This first printed circuit board may also be referred to using other terms, such as motherboard, main board, or multilayer board.

On occasion, it may be desirable to attach a second printed circuit board to this first printed circuit board for each electronic device. This second printed circuit board may be referred to as a daughter card or board. For example, it may be desirable to attach a video card to a first printed circuit board for each of a particular type of electronic device made. In other situations, it may be desirable to provide optional cards or boards that may be attached to the first printed circuit board. For example, additional memory may be made available on optional cards that may be attached to the first printed circuit board. This enables a supplier to provide devices having varying amounts of memory. Also, other types of functionality, such as wireless or other networking functions, may be included on these optional cards. Accordingly, embodiments of the present invention provide connectors that may attach these daughter or optional cards to the first printed circuit board.

Figure 1:
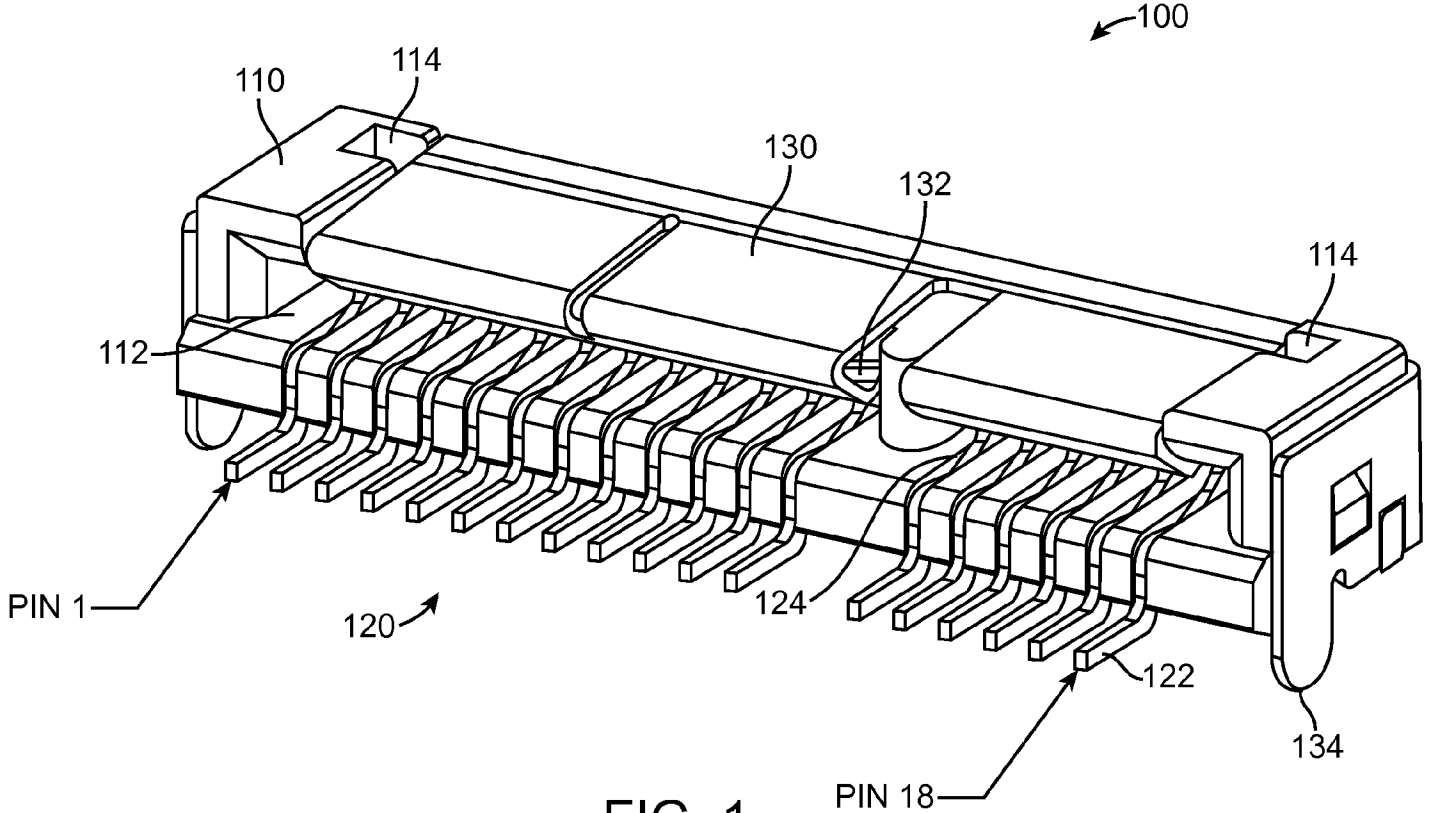
FIG. 1 illustrates a top perspective view of a connector according to an embodiment of the present invention.

FIG. 1 illustrates a top perspective view of a connector according to an embodiment of the present invention. This figure, as with the other included figures, is shown for illustrative purposes and does not limit either the possible embodiments of the present invention or the claims.

Connector 100 may include insulative housing 110, a plurality of contacts 120, and shield 130. This connector may be mounted on a printed circuit board. The printed circuit board may be a motherboard, main board, multilayer board, or other type of board. Connector 100 may be adapted to receive a card or board, such as a daughter or optional card or board.

Insulative housing 110 may include front side opening 112 for receiving a daughter or optional card. Insulative housing 110 may also include one or more openings 114, shown in this example on a top side of insulative housing 110. These one or more openings 114 may be used to visually or otherwise determine that a card is properly inserted into connector 100.

In this example, each of the plurality of contacts 120 may include a first portion 122 and a second portion 124. First portion 122 may extend away from a front of housing 110. First portion 122 may be used to make contact with a contact or pad located on a printed circuit board. Second portion 124 may be approximately in line with first portion 122. Second portion 124 may make contact with a contact on a card when the card is inserted into connector 100. Each of the contacts 120 may also include a third portion (not shown) for mechanical stability, as will be discussed below.

Shield 130 may cover at least a top portion and a back portion of connector 100. Shield 130 may be used as a ground plane, where it connects to one or more ground contacts on a card and one or more ground contacts on the printed circuit board. Shield 130 may be split into two or more portions. In this specific example, shield 130 may be split into three portions. Splitting shield 130 into portions may improve the grounding provided by shield 130 by ensuring that shield 130 comes into contact with ground contacts on a card at three or more points when the card is inserted into connector 100. In this specific example, one or more portions 132 of shield 130 may be folded back under a top portion of shield 130. With this arrangement, when a card is inserted into opening 112 of connector 100, shield portion 132 may press down on a top surface of the card, thereby engaging one or more ground contacts. This action may also push contacts on the card into second portions 124 of contacts 120 to form electrical pathways. Tabs 134 may be located on shield 130 and may be used to connect shield 130 to grounds on a printed circuit board.

Connector 100 may further include keying portion 150. Keying portion 150 may be offset from a center of connector 100. Keying portion 150 may be arranged to mate with a slot or cutout section on a daughter board or optional card. This configuration may prevent the inadvertent upside-down insertion of the daughter board or optional card.

Embodiments of the present invention may provide connectors having high-speed paths between a daughter or optional card and a printed circuit board. Specifically, first portions 122 and second portions 124 of contacts 120 may form short and direct paths over which one or more signals and power supplies may travel. Also, these paths may be shielded by shield 130, which may improve signal quality and allows for faster data rates. By splitting shield 130 into multiple portions, ground connections between ground on a card and a shield may be improved.

Moreover, the short and direct paths provided by contacts 120 may allow connector 100 to have a low profile. A third portion of contacts 120 may be used to provide mechanical stability. This third portion may be approximately in line with first portions 122, and parallel to a bottom of the connector 100.

Embodiments of the present invention may provide connectors that improve the reliability of the manufacturing process. Specifically, first portions 122 may be surface mounted contacts. These first portions 122 may be soldered to pads or contacts on the printed circuit board. This may allow for easy inspection of solder connections of contacts 122 the printed circuit board. Also, openings 114 may allow for inspection to ensure that a card is properly inserted into connector 100.

Figure 2:
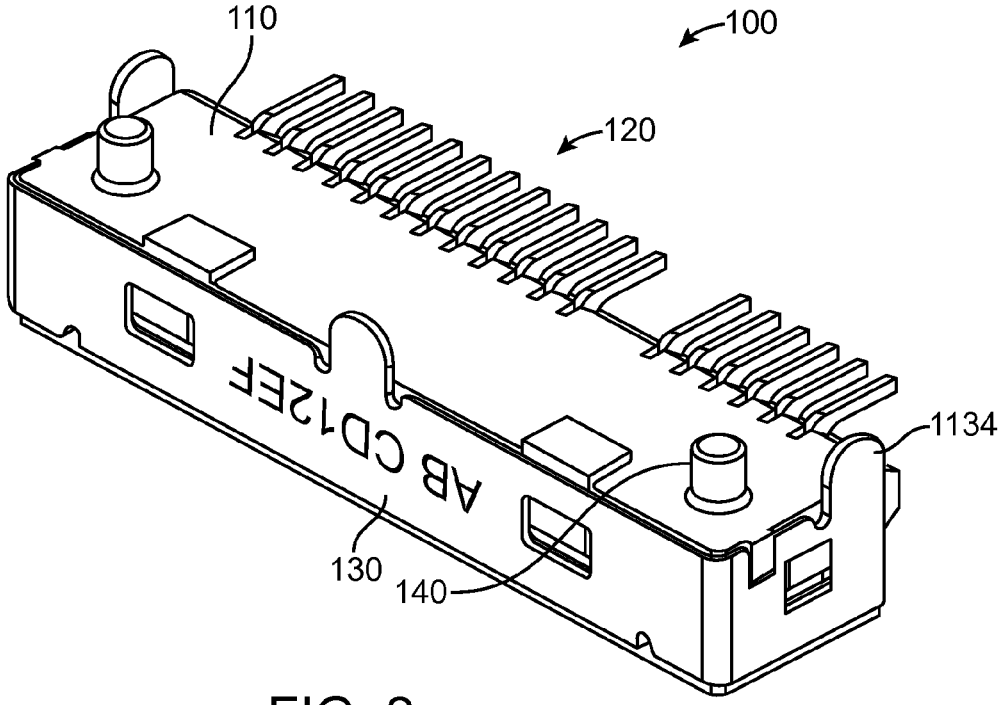
FIG. 2 illustrates a bottom perspective view of a connector according to an embodiment of the present invention.

FIG. 2 illustrates a bottom perspective view of a connector 100 according to an embodiment of the present invention. This figure includes insulative housing 110, a plurality of contacts 120, and shield 130.

Insulative housing 110 may include tabs 140. These tabs may be used to provide mechanical support for connector 100 on a printed circuit board.

Tab 134 may be used to form an electrical connection between shield 130 and ground lines or planes on a printed circuit board.

In various embodiments of the present invention, housing 110 may be plastic or other insulative material. Contacts 120 may be stainless steel, copper, brass, aluminum, or other conductive material. Similarly, shield 130 may be stainless steel, copper, brass, aluminum, or other conductive material.

While eighteen contacts are shown in this specific example, in other embodiments of the present invention, other numbers of contacts may be used. Also, while first portions 122 are shown as extending from the front of contacts 100, in other embodiments of the present invention they may extend in other directions. For example, they may extend in a downward direction, or they may extend towards the back of connector 100. In other embodiments of the present invention, first portions 122 and second portions 124 of contacts 120 may be the same portion. Moreover, while shield 130 is shown as having a particular configuration, other configurations may be possible. For example, shield 130 may not be split into multiple portions, while in other embodiments of the present invention, shield 130 may be split into two or more portions. Also, while one or more openings 114 are shown in top of insulative housing 110, in other embodiments, these openings may be omitted, there may be more or fewer than two openings 140, and the openings may be provided elsewhere.

Again, connector 100 may accept or receive a daughter or optional card. An example is shown in the following figure.

Figure 3:
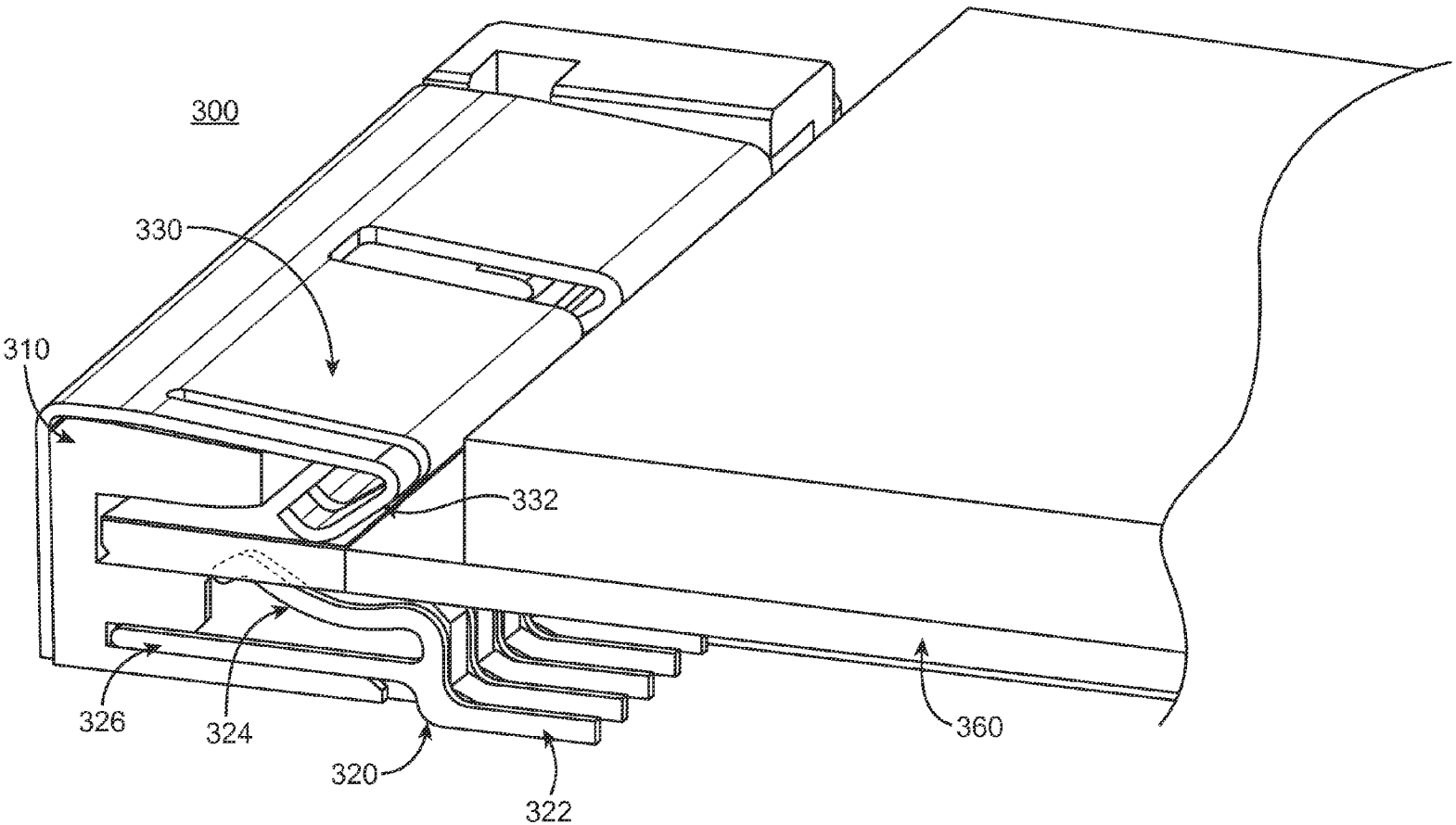
FIG. 3 illustrates a daughter or optional card inserted into a connector according to an embodiment of the present invention.

FIG. 3 illustrates a daughter or optional card inserted into a connector according to an embodiment of the present invention. This example includes a connector 300 receiving a daughter or optional card 360. When card 360 is inserted into connector 300, contacts on a top of card 360 may form electrical connections with portion 332 of shield 330. Contacts on a bottom portion of card 360 may form electrical connections with second portions 324 of contacts 320.

Again, embodiments of the present invention may provide a very short signal path from card 310 to a printed circuit board on which connector 300 resides. Specifically, the signal path may include first portion 322 and second portion 324 of contacts 320.

Contacts 320 may also provide mechanical stability by including third portion 326. Specifically, third portion 326 may extend into insulative housing 310. In this example, second portion 324 and third portion 326 may extend into insulative housing 310, while first portion 322 may extend away from the front of connector 300. Second portion 324 and third portion 326 of contact 320 may be approximately in line with first portion 322. Third portion 326 may extend approximately parallel to a bottom of connector 300.

Figure 4:
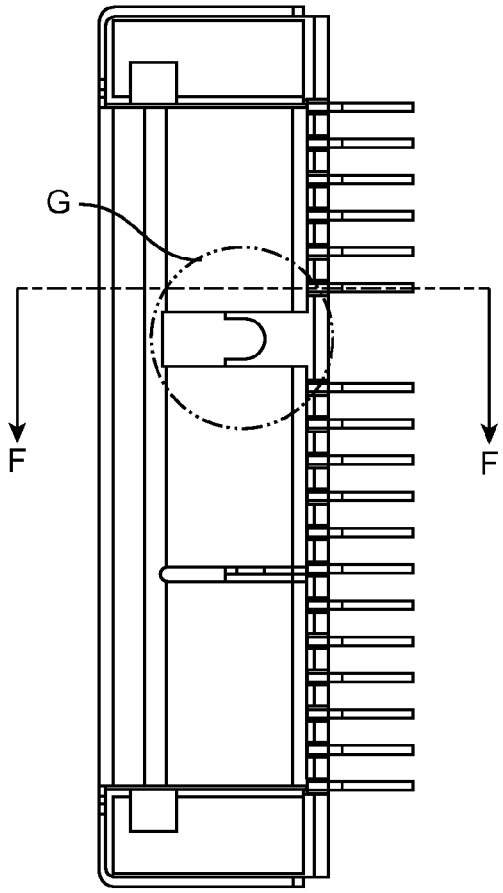
FIG. 4 illustrates a top view of a connector according to an embodiment of the present invention.

FIG. 4 illustrates a top view of a connector according to an embodiment of the present invention.

Figure 5:
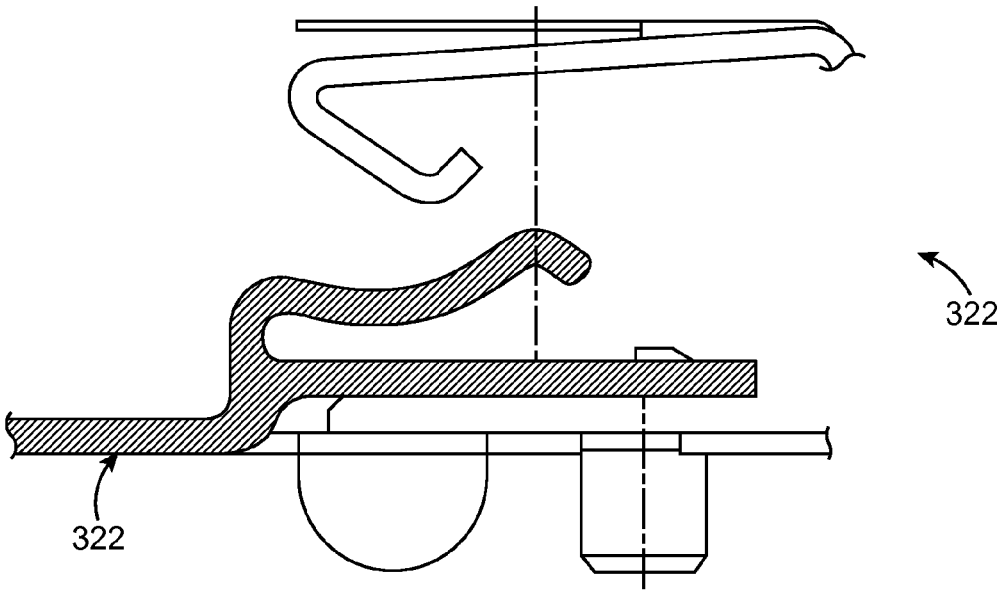
FIG. 5 illustrates a cross-section of view of a connector receptacle according to an embodiment of the present invention.

FIG. 5 illustrates a cross-sectional view along the line F-F of the connector receptacle of FIG. 4. This figure illustrates a cross-sectional view of contact 520 and shield 530 according to an embodiment of the present invention.

Figure 6:
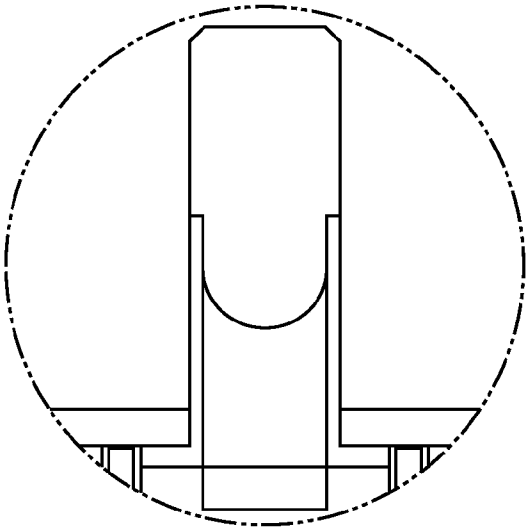
FIG. 6 illustrates a detail of a portion of a top of a connector according to an embodiment of the present invention.

FIG. 6 illustrates a detail of a portion of the top of a connector according to an embodiment of the present invention.

Figure 7:
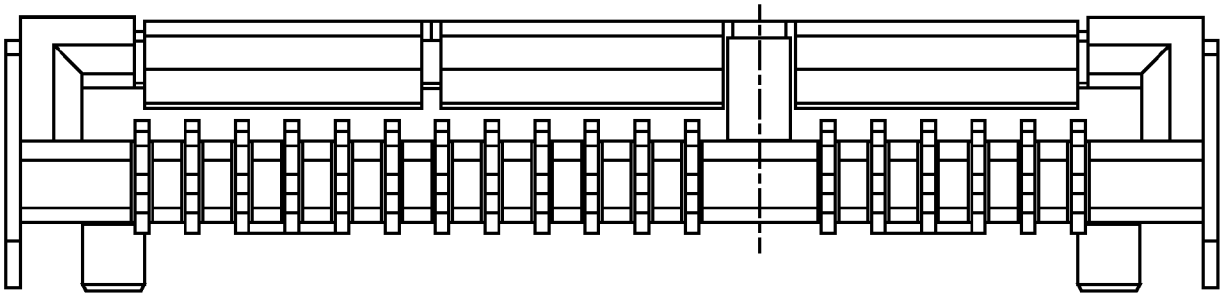
FIG. 7 illustrates a front view of a connector according to an embodiment of the present invention.

FIG. 7 illustrates a front view of a connector according to an embodiment of the present invention.

Figure 8:
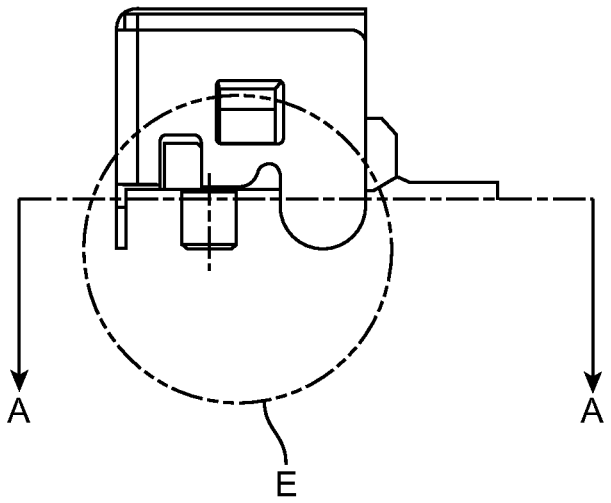
FIG. 8 illustrates a side view of a connector according to an embodiment of the present invention.

FIG. 8 illustrates a side view of a connector according to an embodiment of the present invention.

Figure 9:
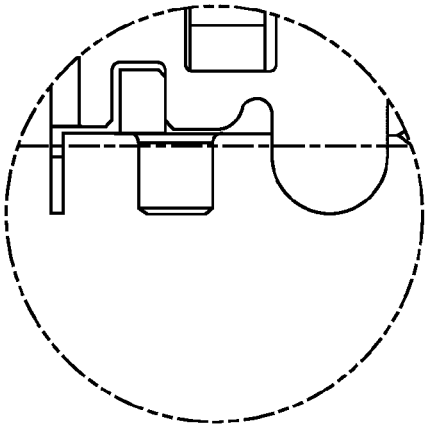
FIG. 9 illustrates a detail of a side view according to an embodiment of the present invention.

FIG. 9 illustrates a detail of a side view according to an embodiment of the present invention.

Figure 10:
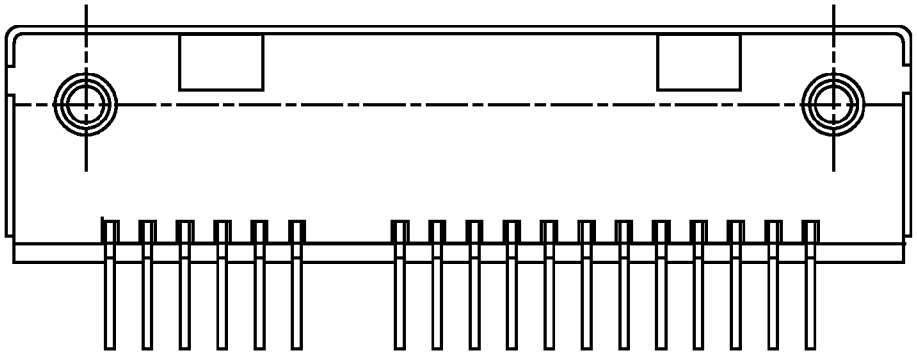
FIG. 10 illustrates a bottom view of a connector according to an embodiment of the present invention.

FIG. 10 illustrates a bottom view of a connector according to an embodiment of the present invention.

Again, various embodiments of the present invention may include various numbers of contacts. Also, in various embodiments of the present invention, one or more of these contacts may have different widths or lengths. For example, one or more contacts may be wider to handle higher currents. These one or more contacts may be used to convey a power supply or ground.

Figure 11:
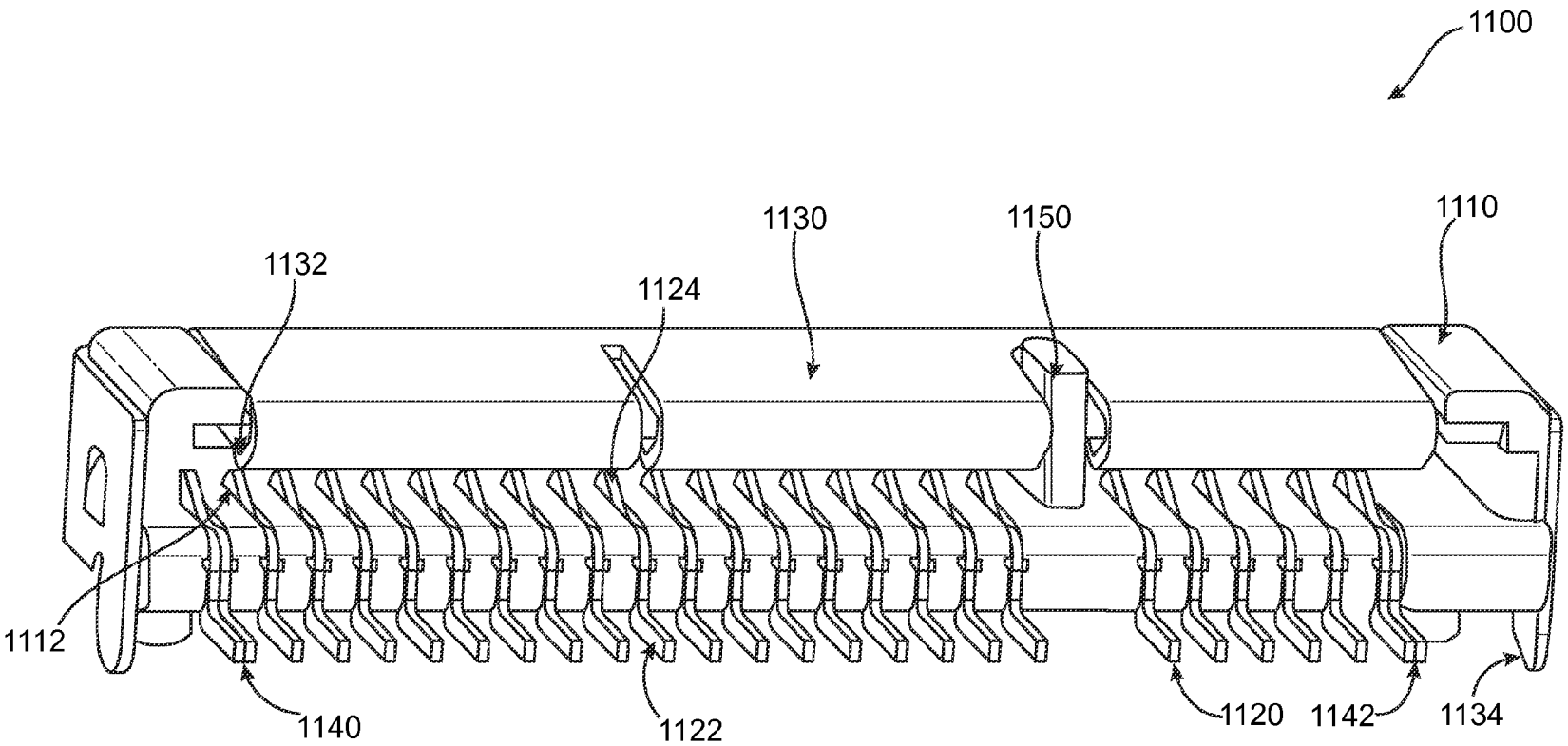
FIG. 11 illustrates a top perspective view of a connector having wider contacts according to an embodiment of the present invention.

FIG. 11 illustrates a top perspective view of a connector having wider contacts according to an embodiment of the present invention. In this example, contacts 1140 and 1142 may be located on each end of connector 1100. Contacts 1140 and 1142 may both be used to convey power, one contact may be used to convey power while the other conveys ground, or both contacts 1140 and 1142 may be used to convey ground. In this example, contacts 1140 and 1142 are formed by placing two contacts 1120 next to each other. These contacts may be separate contacts when assembled, or they may be spot welded or otherwise fixed to each other before assembly.

Connector 1100 may include insulative housing 1110, a plurality of contacts 1120, and shield 1130. Again, this connector may be mounted on a printed circuit board. The printed circuit board may be a motherboard, main board, multilayer board, or other type of board. Connector 1100 may be adapted to receive a card or board, such as a daughter or optional card or board. Specifically, insulative housing 1110 may include front side opening 1112 for receiving a daughter or optional card.

In this example, each of the plurality of contacts 1120 may include a first portion 1122 and a second portion 1124. First portion 1122 may extend away from a front of housing 1110. First portion 1122 may be used to make contact with a contact or pad located on a printed circuit board. Second portion 1124 may be approximately in line with first portion 1122. Second portion 1124 may make contact with a contact on a card when the card is inserted into connector 1100. Each of the contacts 1120 may also include a third portion (not shown) for mechanical stability, as was discussed above.

Shield 1130 may cover at least a top portion and a back portion of connector 1100. Shield 1130 may be used as a ground plane, where it connects to one or more ground contacts on a card and one or more ground contacts on the printed circuit board. Shield 1130 may be split into two or more portions. In this specific example, shield 1130 may be split into three portions. One or more portions 1132 of shield 1130 may be folded back under a top portion of shield 1130.

Connector 1100 may further include keying portion 1150. Keying portion 1150 may be offset from a center of connector 1100. Keying portion 1150 may be arranged to mate with a slot or cutout section on a daughter board or optional card. This configuration may prevent the inadvertent upside-down insertion of the daughter board or optional card.

Embodiments of the present invention may provide connectors having high-speed paths between a daughter or optional card and a printed circuit board. Specifically, first portions 1122 and second portions 1124 of contacts 1120 may form short and direct paths over which one or more signals and power supplies may travel. Moreover, the short and direct paths provided by contacts 1120 may allow connector 1100 to have a low profile. A third portion of contacts 1120 may be used to provide mechanical stability. This third portion may be approximately in line with first portions 1122, and parallel to a bottom of the connector 1100.

Again, various embodiments of the present invention may include various numbers of pins. The example in FIG. 1 includes 18 pins, while the example in FIG. 11 includes 24 pins, and an example below includes 26 pins. These additional pins may be used for additional data, power supplies, grounds, bias, control lines, or other electronic signals. One embodiment of the present invention may include 26 pins, where four pins—two on each end—may be used to convey a power supply. These power contacts may have the same width as other contacts, they may be double contacts as shown in FIG. 11, or they may be wider single contacts. An example is shown in the following figure.

Figure 12:
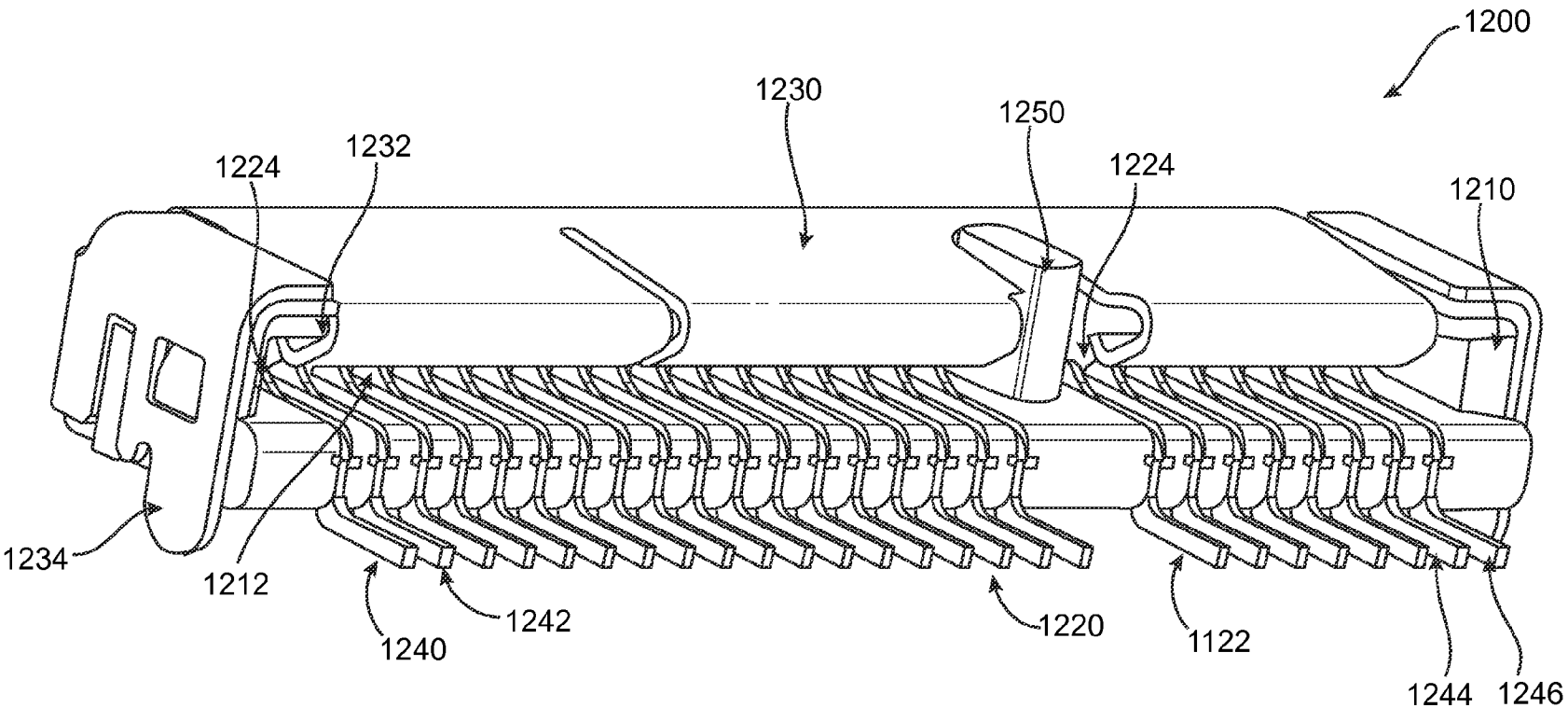
FIG. 12 illustrates a top perspective view of another connector having wider contacts according to an embodiment of the present invention.

FIG. 12 illustrates a top perspective view of another connector having wider contacts according to an embodiment of the present invention. In this example, contacts 1240 and 1242 may be located at one end of connector 1200, while contacts 1244 and 1246 may be located at the other. Contacts 1240, 1242, 1244, and 1246 may each be used to convey power, some may be used to convey power while the others convey ground, or contacts 1240, 1242, 1244, and 1246 may be used to convey ground. In this example, contacts 1240, 1242, 1244, and 1246 are formed as wider contacts as compared to contacts 1220.

Connector 1200 may include insulative housing 1220, a plurality of contacts 1220, and shield 1230. This connector may be mounted on a printed circuit board. The printed circuit board may be a motherboard, main board, multilayer board, or other type of board. Connector 1200 may be adapted to receive a card or board, such as a daughter or optional card or board. Insulative housing 1210 may include front side opening 1212 for receiving a daughter or optional card.

In this example, each of the plurality of contacts 1220 may include a first portion 1222 and a second portion 1224. First portion 1222 may extend away from a front of housing 1210. First portion 1222 may be used to make contact with a contact or pad located on a printed circuit board. Second portion 1224 may be approximately in line with first portion 1222. Second portion 1224 may make contact with a contact on a card when the card is inserted into connector 1200. Each of the contacts 1220 may also include a third portion (not shown) for mechanical stability, as was discussed above.

Shield 1230 may cover at least a top portion and a back portion of connector 1200. Shield 1230 may be used as a ground plane, where it connects to one or more ground contacts on a card and one or more ground contacts on the printed circuit board. Shield 1230 may be split into two or more portions. In this specific example, shield 1230 may be split into three portions. Splitting shield 1230 into portions may improve the grounding provided by shield 1230 by ensuring that shield 1230 comes into contact with ground contacts on a card at three or more points when the card is inserted into connector 1200. In this specific example, one or more portions 1232 of shield 1230 may be folded back under a top portion of shield 1230. With this arrangement, when a card is inserted into opening 1212 of connector 1200, shield portion 1232 may press down on a top surface of the card, thereby engaging one or more ground contacts. This action may also push contacts on the card into second portions 1224 of contacts 1220 to form electrical pathways. Tabs 1234 may be located on shield 1230 and may be used to connect shield 1230 to grounds on a printed circuit board.

Connector 1200 may further include keying portion 1250. Keying portion 1250 may be offset from a center of connector 1200. Keying portion 1250 may be arranged to mate with a slot or cutout section on a daughter board or optional card. This configuration may prevent the inadvertent upside-down insertion of the daughter board or optional card.

Embodiments of the present invention may provide connectors having high-speed paths between a daughter or optional card and a printed circuit board. Specifically, first portions 1222 and second portions 1224 of contacts 1220 may form short and direct paths over which one or more signals and power supplies may travel. Also, these paths may be shielded by shield 1230, which may improve signal quality and allows for faster data rates. By splitting shield 1230 into multiple portions, ground connections between ground on a card and a shield may be improved.

Moreover, the short and direct paths provided by contacts 1220 may allow connector 1200 to have a low profile. A third portion of contacts 1220 may be used to provide mechanical stability. This third portion may be approximately in line with first portions 1222, and parallel to a bottom of the connector 1200.

Embodiments of the present invention may provide connectors that improve the reliability of the manufacturing process. Specifically, first portions 1222 may be surface mounted contacts. These first portions 1222 may be soldered to pads or contacts on the printed circuit board. This may allow for easy inspection of solder connections of contacts 1222 the printed circuit board. Also, openings 1214 may allow for inspection to ensure that a card is properly inserted into connector 1200.

Figure 13:
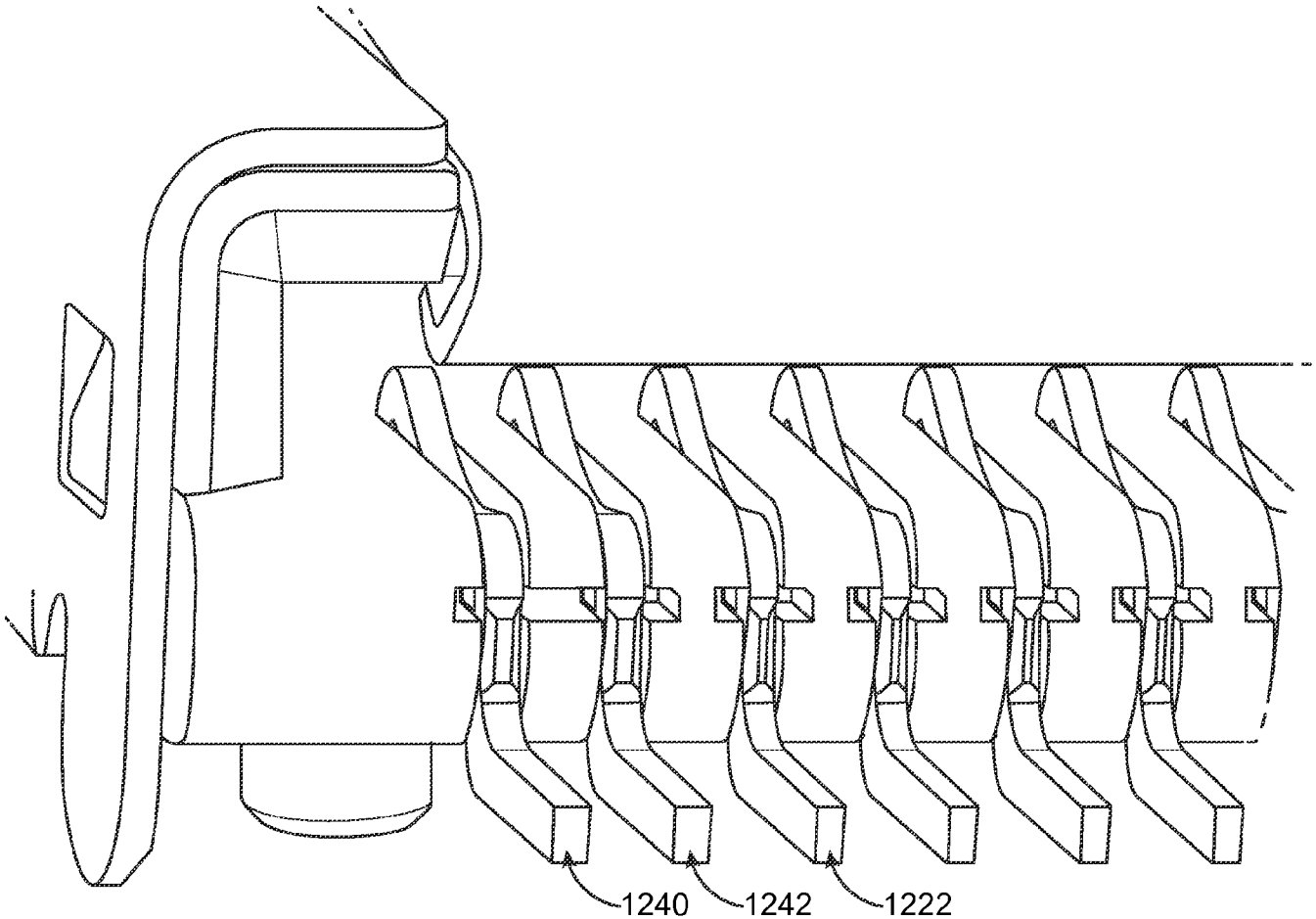
FIG. 13 is a closer view of a portion of a connector according to an embodiment of the present invention.

FIG. 13 is a closer view of a portion of a connector according to an embodiment of the present invention. In this figure, contacts 1240 and 1242 can be seen as being wider than contact 1222. Again, contacts 1240 and 1242 may both be used to convey power, one contact may be used to convey power while the other conveys ground, or both contacts 1240 and 1242 may be used to convey ground. Contacts 1222 may be used to convey data, bias, supplies, or other type of electronic signals. In other embodiments, contacts 1222, 1240, and 1242 may be used to convey other types of electronic signals or information.

In various embodiments of the present invention, tabs, such as tabs 134, 1134, and 1234 may be used to provide a ground connection for shields 130, 1130, or 1230. In other embodiments of the present invention, other ground connections may be used in addition to, or instead of, tabs 134, 1134, and 1234. An example is shown in the following figure.

Figure 14:
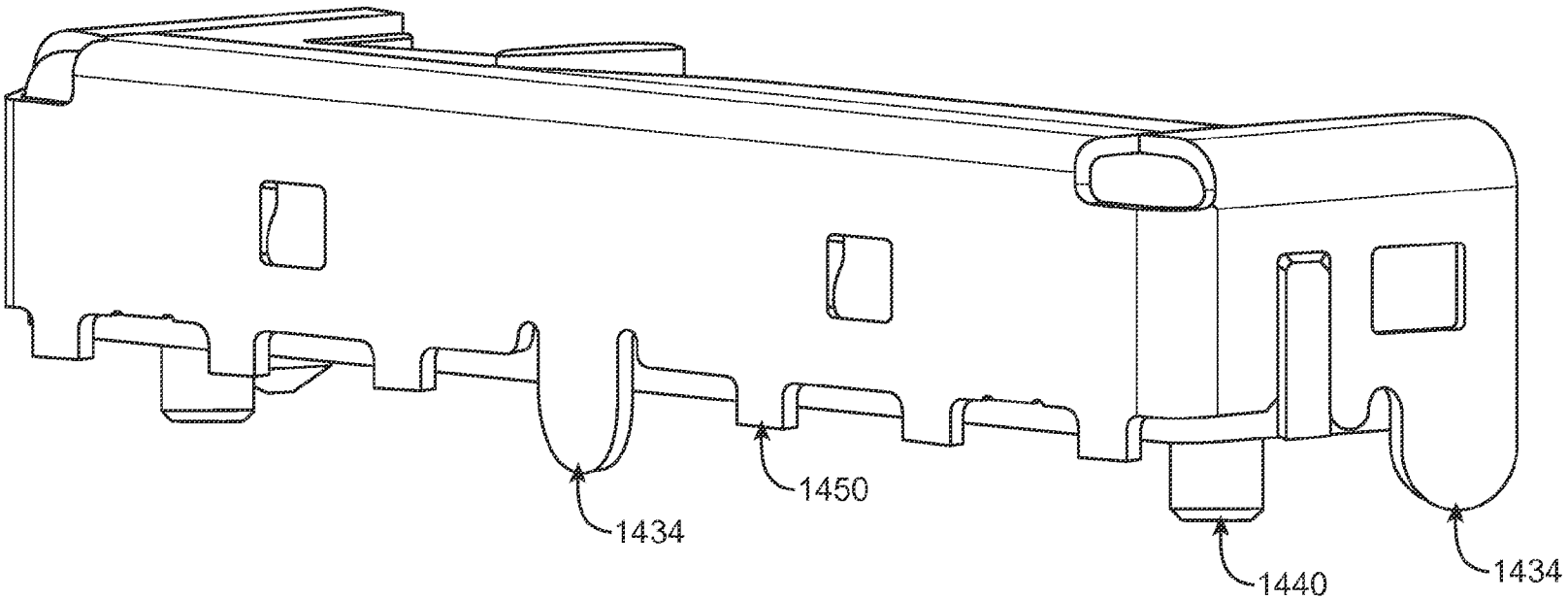
FIG. 14 illustrates a backside view of a connector according to an embodiment of the present invention.

FIG. 14 illustrates a backside view of a connector according to an embodiment of the present invention. This example includes solder ends 1450 in addition to tabs 1434. Solder ends 1450 may be soldered to ground connections on a printed circuit board. Spacings between solder ends 1450 may allow signal paths to be routed. Post 1440 is also included for mechanical stability.

Again, in these examples, illustrative examples of embodiment of the present invention have been shown. It should be noted that variations on portions of these connectors, such as insulative housings 110, 1110, and 1210; contacts 120, 1120, and 1220; and shields 130, 1130, and 1230, and portions thereof, may be made consistent with embodiments of the present invention, and none of these are required to have the particular shape, size, arrangement, or other characteristics shown in the figures in order for a connector according to an embodiment of the present invention to function properly.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector to form a plurality of signal paths between a printed circuit board and a card, the connector comprising:

an insulative housing having an opening in a front surface to receive the card;

a plurality of contacts, each having:

a first portion extending away from the front surface of the insulative housing to attach to a contact on a surface of the printed circuit board;

a second portion approximately in line with the first portion to form an electrical connection with a contact on the card; and a third portion extending into the insulative housing; and a shield over at least a top and back portion of the insulative housing, wherein at least two contacts are placed next to each other such that a larger contact is formed, and wherein the first portion of each of the plurality of contacts extends beyond a front of the insulative housing and the shield.

2. The connector of claim 1 wherein the card is a memory card.

3. The connector of claim 1 wherein the card is a solid state drive.

4. The connector of claim 1 wherein the card is a wireless networking card.

5. The connector of claim 1 wherein the first portion comprises a surface mount connector.

6. The connector of claim 1 wherein the third portion extends into the insulative housing in a direction approximately parallel to a bottom of the connector.

7. The connector of claim 1 wherein the third portion provides mechanical stability.

8. The connector of claim 1 wherein the shield provides a ground plane.

9. The connector of claim 1 wherein the shield holds the card in place when the card is inserted into the connector.

10. The connector of claim 1 wherein the shield is split into multiple portions.

11. A connector comprising:

an insulative housing having an opening in a front surface and at least one opening in a top surface;

a plurality of first contacts, each having:

a first portion extending away from the front surface of the insulative housing; and a second portion approximately in line with the first portion;

a plurality of second contacts, wider than contacts in the first plurality of contacts and each having:

a first portion extending away from the front surface of the insulative housing; and a second portion approximately in line with the first portion; and a shield over at least a top and back portion of the insulative housing to form a ground plane, wherein the first portion of each of the plurality of first contacts and the first portion of each of the plurality of second contacts extend beyond a front of the insulative housing and the shield.

12. The connector of claim 11 wherein the connector is arranged to receive a card, wherein the at least one opening in the top surface may be used to ensure the card is properly received by the card.

13. The connector of claim 11 where the insulative housing comprises two openings in the top surface, wherein the openings in the top surface may be used to ensure the card is properly received by the connector.

14. The connector of claim 11 wherein each of the plurality of contacts further comprises a third portion extending into the insulative housing.

15. The connector of claim 14 wherein the third portion provides mechanical support.

16. The connector of claim 15 wherein the third portion is approximately in line with the first portion and extends into the housing in a direction approximately parallel to a bottom of the connector.

17. The connector of claim 11 wherein the shield holds a card in place when a card is inserted into the connector.

18. The connector of claim 17 wherein the shield is split into multiple portions.

19. A connector to form a plurality of signal paths, the connector comprising:

an insulative housing having an opening in a front surface;

a plurality of contacts including a first contact and a second contact, the first contact wider than the second contact, the first and second contact each having:

a first portion extending away from the front surface of the insulative housing;

a second portion approximately in line with the first portion; and a third portion extending into the insulative housing to provide mechanical support; and a shield over at least a top and back portion of the insulative housing, wherein the first portion of each of the plurality of first contacts and the first portion of each of the plurality of second contacts extend beyond a front of the insulative housing and the shield.

20. The connector of claim 19 where the insulative housing comprises a plurality of openings in the top surface, wherein the plurality of openings in the top surface may be used to ensure a card is properly received by a connector.

21. The connector of claim 19 wherein the first portion comprises a surface mount connector.

22. The connector of claim 19 wherein the shield holds a card in place when the card is inserted into the connector.

23. The connector of claim 22 wherein the shield is split into multiple portions.

24. The connector of claim 22 wherein the card is a solid state drive.

25. The connector of claim 22 wherein the card is a wireless networking card.

* * * * *